US008464493B2

(12) United States Patent
Boone et al.

(10) Patent No.: US 8,464,493 B2
(45) **Date of Patent: *Jun. 18, 2013**

(54) TRANSPORTABLE MODULAR CONFIGURATION FOR HOLDING PANELS

(75) Inventors: Nicholas Boone, Vicksburg, MS (US); Bartley P. Durst, Clinton, MS (US); Toney K. Cummins, Vicksburg, MS (US); Pamela G. Kinnebrew, Vicksburg, MS (US); William F. Heard, Clinton, MS (US); Thomas R. Slawson, Vicksburg, MS (US); Michael J. Roth, Raymond, MS (US); Ryan Stinson, Prairieville, LA (US); Reed Mosher, Vicksburg, MS (US); Jerry C. Edwards, Huntsville, AL (US); Andrew B. Edwards, Toney, AL (US); Jason D. Edwards, Meridianville, AL (US); Shane H. Sanford, Franklin, TN (US); Robert A. Pilgrim, Benton, KY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 42 days.

This patent is subject to a terminal disclaimer.

(21) Appl. No.: 12/920,499

(22) PCT Filed: Mar. 2, 2009

(86) PCT No.: PCT/US2009/035707

§ 371 (c)(1),
(2), (4) Date: Sep. 1, 2010

(87) PCT Pub. No.: WO2009/148652

PCT Pub. Date: Dec. 10, 2009

(65) Prior Publication Data

US 2011/0000514 A1 Jan. 6, 2011

Related U.S. Application Data

(60) Provisional application No. 61/033,059, filed on Mar. 3, 2008.

(51) Int. Cl.
*E04H 12/18* (2006.01)
*A47G 5/00* (2006.01)
*E06B 9/06* (2006.01)

(52) U.S. Cl.
USPC ..... 52/646; 52/641; 52/645; 52/648.1; 52/653.1; 160/135; 160/351; 160/352; 160/377; 89/36.07

(58) Field of Classification Search
USPC .. 160/135, 351, 352, 377, 379, 405; 135/123, 135/121, 126, 128, 143, 151; 52/36.1, 641, 52/648.1, 649.5, 653.1, 645–646, DIG. 12; 89/36.01, 36.02, 36.07
See application file for complete search history.

(56) References Cited

U.S. PATENT DOCUMENTS 2,888,072 A * 5/1959 Nicholas ..... 160/377
4,995,212 A * 2/1991 Morgan et al. ..... 52/646

(Continued)

FOREIGN PATENT DOCUMENTS

WO WO2009/114319 A2 9/2009
WO WO2009/148652 A2 12/2009

OTHER PUBLICATIONS

U.S. Appl. No. 12/397,448, Dubey, et al.

(Continued)

*Primary Examiner* — Jeanette E. Chapman
(74) *Attorney, Agent, or Firm* — Brian C. Jones

(57) ABSTRACT

A configuration, all components of which are man portable in some embodiments, for holding panels to protect assets against external force and impacts from airborne projectiles. An open box-like stackable frame module holds panels along a side of the frame. Multiple frames are connected to construct a protective barrier, such as a wall. Frames include provisions for connection in a vertical configuration so as to allow stacking of the frames to increase the height of the barrier. A method of installing is also provided.

25 Claims, 12 Drawing Sheets

U.S. PATENT DOCUMENTS

| | | | | |
|---|---|---|---|---|
| 5,230,196 | A * | 7/1993 | Zeigler | 52/646 |
| 5,327,700 | A * | 7/1994 | Sorenson et al. | 52/109 |
| 5,826,397 | A * | 10/1998 | Armold | 52/646 |
| 6,161,462 | A | 12/2000 | Michaelson | |
| 6,374,843 | B1 * | 4/2002 | Zou | 135/145 |
| 6,439,120 | B1 | 8/2002 | Burealix et al. | |
| 6,829,869 | B1 * | 12/2004 | Savoie | 52/648.1 |
| 6,907,811 | B2 | 6/2005 | White | |
| 2007/0175126 | A1 | 8/2007 | Tonyan et al. | |
| 2009/0239977 | A1 | 9/2009 | Dubey et al. | |

OTHER PUBLICATIONS

U.S. Appl. No. 12/394,396, Tonyan, et al.

U.S. Appl. No. 12/394,564, Tonyan, et al.

* cited by examiner

TRANSPORTABLE MODULAR CONFIGURATION FOR HOLDING PANELS

RELATED APPLICATIONS

This application is a national stage under U.S.C. §371, of International Application No. PCT/US09/35,707, filed Mar. 2, 2009, which claims the benefit under 35 U.S.C. §119(e)(1) of U.S. Provisional Patent Application Ser. No. 61/033,059, Transportable Modular Configuration for Holding Panels, filed Mar. 3, 2008, both incorporated herein by reference. This application is also related to U.S. Provisional Patent Application No. 61/033,240, Method of Manufacturing Cement Based Armor Panels filed Mar. 3, 2008; U.S. Pat. No. 8,030,377B2 which claims the benefit under 35 U.S.C. §119 (e)(1) of U.S. Provisional Patent Application No. 61/033,212, A Self-Leveling Cementitious Composition with Controlled Rate of Strength Development and Ultra-High Compressive Strength upon Hardening and Articles Made from Same filed Mar. 3, 2008; U.S. Pat. No. 8,062,741B2 which claims the benefit under 35 U.S.C. §119(e)(1) of U.S. Provisional Patent Application No. 61/033,264, Cement Based Laminated Armor Panels; U.S. Pat. No. 8,061,257B2 which claims the benefit under 35 U.S.C. §119(e)(1) of U.S. Provisional Patent Application No. 61,033,258, Cement Based Armor Panel System, filed Mar. 3, 2008; and U.S. National Stage patent application Ser. No. 12,920,497 which claims the benefit under 35 U.S.C. §119(e)(1) of U.S. Provisional Patent Application Ser. No. 61/033,061, Transportable Modular System Permitting Isolation of Assets, filed Mar. 3, 2008, all the above incorporated herein by reference.

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. Research supporting at least part of the work described herein was accomplished with the United States Gypsum Company under a Cooperative Research and Development Agreement, CRADA-05-GSL-04, dated 20 May 2005. This and related patents are available for licensing to qualified licensees. Please contact Phillip Stewart at 601 634-4113.

BACKGROUND

It is important to protect both material and personnel from catastrophe, especially in cases where the probability of occurrence is greater than the norm. Conventionally, both temporary and permanent means may be used for this purpose, depending on the scenario. For example, a permanent military facility may best be protected by a permanent configuration, whereas a mobile field unit would best be served by a temporary, but not necessarily less effective, configuration. Conventionally, protection against manmade catastrophe, such as occurs in war zones, has been provided with large bulky concrete structures or earthen embankments that require heavy equipment to produce, whether temporary or permanent. Common needs for protective structure may include barriers to prevent personnel access, vehicular intrusion, or even line-of-site access, as well as protective enclosures for emergency response personnel or revetments for high value assets. Because of constraints such as geography, response time, availability of both material and heavy equipment, and the like, select embodiments of the present invention that provide good protection for both personnel and valued assets are of value for protection of military, industrial, community and personal assets.

To protect personnel and assets, organizations such as the military use a variety of protective materials ranging from soil cover to expensive, high-performance, lightweight ballistic ceramics. For the military, a need exists for an inexpensive blast and fragmentation barrier for large-area applications, such as forward facilities, installation and structure perimeters, and both interior and exterior protective upgrades. Certain applications call for panels that may be emplaced on robust platforms, both the modular platform sections and panels being of sufficiently light weight to be man portable. Needs for physical protection exist in the commercial, first responder and consumer communities also, but on a different scale. For example, there is a need for a structure to hold inexpensive protective cladding with superior resistance to wind damage, including penetration of debris generated by natural forces, such as tornadoes and hurricanes.

DETAILED DESCRIPTION

Figure 1:
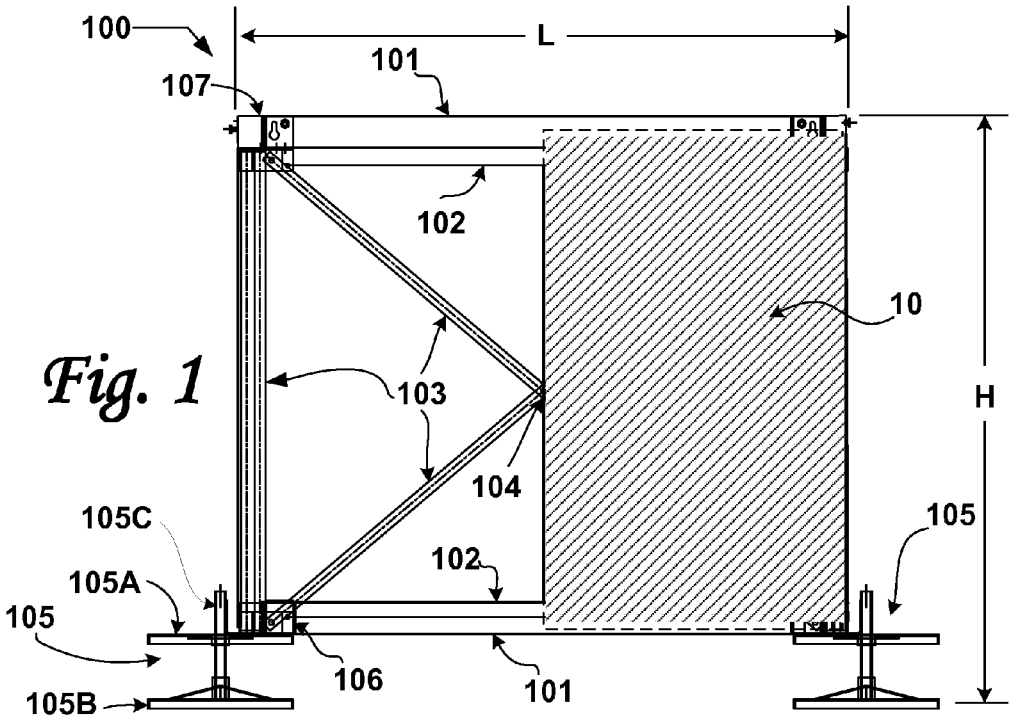
FIG. 1 is an elevation view of a single box-shaped platform and single installed panel thereon that may be employed in embodiments of the present invention.

Select embodiments of the present invention comprise transportable components for fortifying an area. Select embodiments of the present invention include box-shaped platform modules for holding panels in order to provide a secure perimeter. The panels may be resistant to sudden impulses such as may occur with explosions or impact with projectiles and also may shield what they are protecting from view of possible adversaries.

In select embodiments of the present invention, a transportable configuration provides modular support to be combined with panels of pre-specified content for isolation, including physical protection, of assets. A component of select embodiments of the present invention comprises an open stackable frame of a length greater than or equal to its width which in turn is less than or equal to its height. The frame comprises four sides, eight corners and an open top and bottom. In select embodiments of the present invention the frame comprises: mounts at each of its eight corners, four of the mounts being of a first type ("top" mounts) located at the top of the frame and four of the mounts being of a second type ("bottom" mounts) and located at the bottom of the frame such that the top and bottom mounts are able to be interlocked via suitable means to permit vertical stacking as well as horizontal connection of the frames one to another; a pair of cross members in compression on each of the four sides of the frame, such that each cross member of a pair is pivotally joined at its center to the other cross member of the pair thereby allowing pivoting of the pair of cross members in one plane, and such that each cross member is also pivotally joined to one top mount and one bottom mount thereby allowing pivoting of the connected pair of cross members in one plane; and two or more members in tension on each side of the frame, a first member in tension attached to the top mounts and a second member in tension attached to the bottom mounts; pairs of z-bars to be affixed, in one embodiment, along a first longitudinal side of the frame, ends of the z-bars affixed to respective top and bottom mounts; tensioning means for securing the ends of the z-bars to the top and bottom mounts; and four height adjustable bases (leveling pads), on which rest the bottom mounts. The frame is suitable for mounting panels, preferably quadrilateral panels.

In select embodiments of the present invention, third and fourth z-bars are mounted on the longitudinal side of the frame opposite the longitudinal side on which the first two z-bars are mounted. These z-bars accommodate mounting optional panels on the back side (the side away from the origin of external hazards) of the frame.

In select embodiments of the present invention, the cross members are of tubular construction and further comprise means for pivotally connecting each cross member of a pair of cross members at the respective approximate center of each cross member. For example, the means for pivotally connecting may be a bushed rivet or clevis pin. In select embodiments of the present invention the cross members are metal tubes having a quadrilateral cross section, e.g., a square or rectangular cross section.

In select embodiments of the present invention, the members in tension are braided wires affixed to the top and bottom mounts, respectively, horizontally, e.g., via rivets through holes in the top and bottom mounts and end loops on the braided wire from one top mount to another top mount and from one bottom mount to another bottom mount, all on the same frame.

In select embodiments of the present invention, the z-bars are formed from sheet metal and incorporate means for positioning them on the frame and tensioning means for securing the ends of the z-bars to the respective top and bottom mounts.

In select embodiments of the present invention, the top and bottom mounts are formed from sheet metal and further comprise: means for positioning the z-bars on the frame, for example a slot external to the z of the z-bar itself, and means for attaching the tensioning means for connecting the z-bars to the top and bottom mounts, e.g., a strap with hook on one end and a tightening ratchet on the other end; means for connecting to the first and second members in tension, e.g., slots or holes in the top and bottom mounts to which a wire may be affixed via a rivet, clevis pin or the like; channels in the top and bottom mounts for positioning the cross members on the top and bottom mounts, e.g., vertical tabs, with attachment holes, formed in the base of the top and bottom mounts; and means for connecting each end of the cross members in the channels, e.g., bushed pins such as clevis pins or the like.

In select embodiments of the present invention, the adjustable bases comprise: a first plate ("top" plate) for indexing to the bottom mounts, the top plate incorporating a first threaded collar approximately centered in the top plate; a threaded rod incorporating means for moving the threaded rod in the first threaded collar to raise and lower the mount; and a reinforced plate ("bottom" plate) incorporating a second collar for receiving the threaded rod, so that the threaded rod may be turned via the means for moving, such as a hex nut affixed at the top of the threaded rod, to adjust the height of the adjustable base to facilitate interconnecting a frame to adjoining frames.

In select embodiments of the present invention, frames themselves employ four or more vertically oriented connection pins in the top mounts to affix each bottom mount to each top mount to permit vertically stacking of the frames.

In select embodiments of the present invention, a method of installing a modular support for a transportable configuration that provides protection for assets, comprises: providing an open stackable frame having a length greater than or equal to a width that is less than or equal to a height, four sides, and eight corners, the frame comprising: mounts at each of the eight corners of the frame, such that a first four mounts are of a first type (top mounts) located at the top of the frame and a second four mounts are of a second type (bottom mounts) located at the bottom of the frame, a pair of cross members in compression on each of the four sides of the frame, such that each cross member of a pair is pivotally joined at its center to the other cross member of the pair to allow pivoting of the pair of cross members in one plane, and such that each cross member is pivotally joined to one top mount and one bottom mount so as to allow pivoting of the pair of cross members in one plane; and two or more members in tension, such as a braided wire, on each of the four sides of the frame, a first member in tension attached to the top mounts and a second member in tension attached to the bottom mounts. The method further provides z-bars, the z-bars affixed along a longitudinal side of the frame, ends of a first z-bar affixed to tabs on two top mounts and ends of a second z-bar affixed to tabs on two bottom mounts. The method further provides tensioning means, such as wires adjustable for amount of tension, connectable to each end of the z-bars and provides adjustable bases such that each base supports a bottom mount for at least one frame corner depending on the position of frames in a final protective wall. The method further provides eight or more vertically oriented pins, two each pins in the top plates of the adjustable bases for indexing each frame bottom mount to the bases. The method further provides for transporting the support to a location having assets requiring physical protection and unloading the support from its transporting means, such as a truck. The method further comprises completing the following steps to result in support for an isolating wall: a) arranging the adjustable bases on the desired substrate, e.g., the ground, to permit placement of the frames thereon and adjusting the bases to be about six turns from bottoming out; b) leveling the adjustable bases with respect to the substrate; c) placing a first frame, indexing the bottom mounts to the pins in the top plates of the four adjustable bases; d) further arranging two adjustable bases for holding one side of an initially adjoining frame to the originally placed frame and leveling the latter placed two adjustable bases, e) indexing the adjoining frame to the pins of the two adjustable bases common to the initially placed frame and the two further arranged adjustable bases; f) leveling the initially placed frame by adjusting the adjustable bases to facilitate joining the initially placed frame and the adjoining frame at respective top mounts; g) connecting the initially placed frame and the adjoining frames at adjoining top mounts; h) along the length of the frame, attaching a z-bar at the top of each installed frame and a second z-bar at the bottom of each installed frame; i) after inserting a pre-specified number of panels in the z-bars, employing the tensioning means at the ends of each z-bar, thus securing the z-bars to the frame; and j) repeating steps a) through i) treating each added frame as an initially added frame until a pre-specified length of said protective wall is attained.

In select embodiments of the present invention, the method of installation further comprises installing third and fourth z-bars on the side of the frame opposite that on which the first and second z-bars are installed, installing the third and fourth z-bars in a manner identical to that of installing the first and second z-bars; inserting panels between the third and fourth z-bars along the length of each installed frame, and tensioning the z-bars as in step i) above.

In select embodiments of the present invention, the method of installation further comprises: a) stacking one or more frames above each frame of an initially installed protective wall, b) indexing each bottom mount of the added frame to a corresponding top mount of the initially installed frame using the pin on each top mount; c) as necessary, further leveling the adjustable bases with respect to the substrate to facilitate joining each stacked frame to an adjoining stacked frame at the respective top mounts of the stacked frame; d) connecting the stacked frames at adjoining top mounts, e.g., via a rivet and slot arrangement; e) along one side of the length of the stacked frame, attaching a z-bar at the top of each installed stacked frame; f) inserting a pre-specified number of panels between the z-bars and, employing the tensioning means at the ends of each added z-bar, securing the added z-bars to each stacked frame; g) repeating steps a)-f) until the pre-specified height of the protective wall is attained.

In select embodiments of the present invention, the method of installation further comprises: installing additional top z-bars on the side of the stacked frame opposite that on which the initially added z-bars are installed, installing the additional top z-bars in a manner identical to that of installing the initially added z-bars; and inserting the pre-specified number of panels between the additionally added top z-bars and the top z-bars of the base frame along the length of the back of each installed stacked frame.

In select embodiments of the present invention, a transportable configuration for holding panels providing protection for assets comprises: an open stackable frame having a length greater than or equal to a width that is less than or equal to a height, four sides, and eight corners. In select embodiments of the present invention, the frame comprises: mounts at each of the eight corners of the frame, such that a first four mounts are of a first type (hereafter top mounts) located at the top of the frame and a second four mounts are of a second type (hereafter bottom mounts) located at the bottom of the frame, and the top mounts are connectable to the bottom mounts via suitable means to permit vertical stacking of the frames as well as horizontal connection of the frames one to another; a pair of cross members in compression on each of the four sides of the frame, wherein each cross member of a pair is pivotally joined at its center to the other cross member of the pair so as to allow pivoting of the pair of cross members in one plane, and such that each cross member is pivotally joined to one top mount and one bottom mount thereby allowing pivoting of the pair of cross members in one plane; and two members in tension on each of the four sides of the frame, a first member in tension, such as a braided wire, attached to each top mount and a second member in tension attached to each bottom mount; z-bars affixed along a first longitudinal side of the frame, ends of a first z-bar affixed to two top mounts and ends of a second z-bar affixed to two bottom mounts, the z-bars suitable for holding panels between top and bottom z-bars; tensioning means, such as a wire attached to a ratcheting adjustment belt, affixed at an end of each z-bar; and height adjustable bases (leveling pads) for supporting the bottom mounts.

In select embodiments of the present invention the configuration is constructed of man portable components and comprises: an open stackable frame having a length greater than or equal to a width that is less than or equal to a height, four sides, and eight corners. The frame of the configuration further comprises: mounts at each of the eight corners of the frame, such that a first four mounts are of a first type ("top" mounts) located at the top of the frame and a second four mounts are of a second type ("bottom" mounts) located at the bottom of the frame, and such that a top mount is connectable to a bottom mount via suitable means to permit vertical stacking of the frames as well as horizontal connection of the frames one to another; a pair of cross members in compression on each side of the frame, such that each cross member of a pair is pivotally joined at its center to the other cross member of the pair thereby allowing pivoting of the pair of cross members in one plane, and such that each cross member is pivotally joined to one top mount and one bottom mount thereby allowing pivoting of the pair of cross members in one plane; and two members in tension on each of the four sides of the frame, a first member in tension, e.g., a braided wire, attached between top mounts and a second member in tension attached between bottom mounts; z-bars affixed along a first longitudinal side of the frame, ends of a first z-bar affixed to two top mounts and ends of a second z-bar affixed to two bottom mounts; tensioning means, such as braided wire incorporating adjustment means such as a ratchet strap, connected to each end of a z-bar; height adjustable bases, each base supporting a bottom mount; and quadrilateral panels having a length and width, each of the length and width much greater than the depth of the panels, such that the panels are constrained in the z-bars to provide physical protection of assets on the side of the configuration away from the source of any physical forces.

In select embodiments of the present invention, all components are man transportable and some components comprise steel having a corrosion resistant finish. In select embodiments of the present invention the length, width and height of the support are equal.

In select embodiments of the present invention the z-bars comprise integral first and second open rectangular channels, the open portion of a first channel facing to the top and the open portion of a second channel facing to the bottom of the configuration, the channels incorporating open ends, the z-bars much longer in length than either width or depth.

In select embodiments of the present invention members in tension comprise wires, such that for each module, four wires are employed with the mounts of a first type and four wires are employed with the mounts of a second type.

In select embodiments of the present invention the cross members have a quadrilateral cross section. In select embodiments of the present invention, the frame modules are foldable to facilitate storage and transport.

Select embodiments of the box-shaped platform modules of the present invention are man portable. Systems, such as walls, employing select embodiments of the present invention are designed to replace existing systems that are heavier, e.g., those that employ thicker panels comprising materials conventionally used for protection from ballistic sources. Because some existing systems are made from costly materials, such as ceramics, they are also more expensive than embodiments of the present invention.

EXAMPLE

Figure 3:
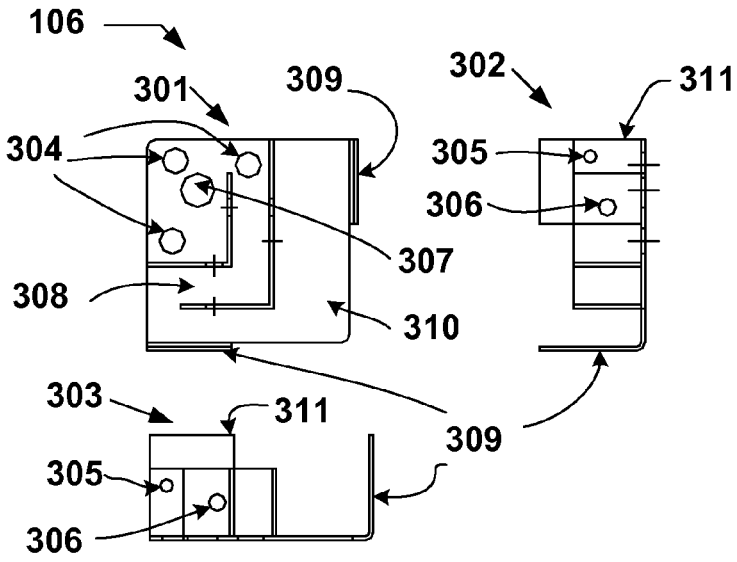
FIG. 3 is a plan view of a mount of a second type, as well as elevation views of the two vertical outer sides of the connector that may be employed in embodiments of the present invention, one of four such mounts of a second type on each of the box-shaped platform modules of FIG. 1.
Figure 4:
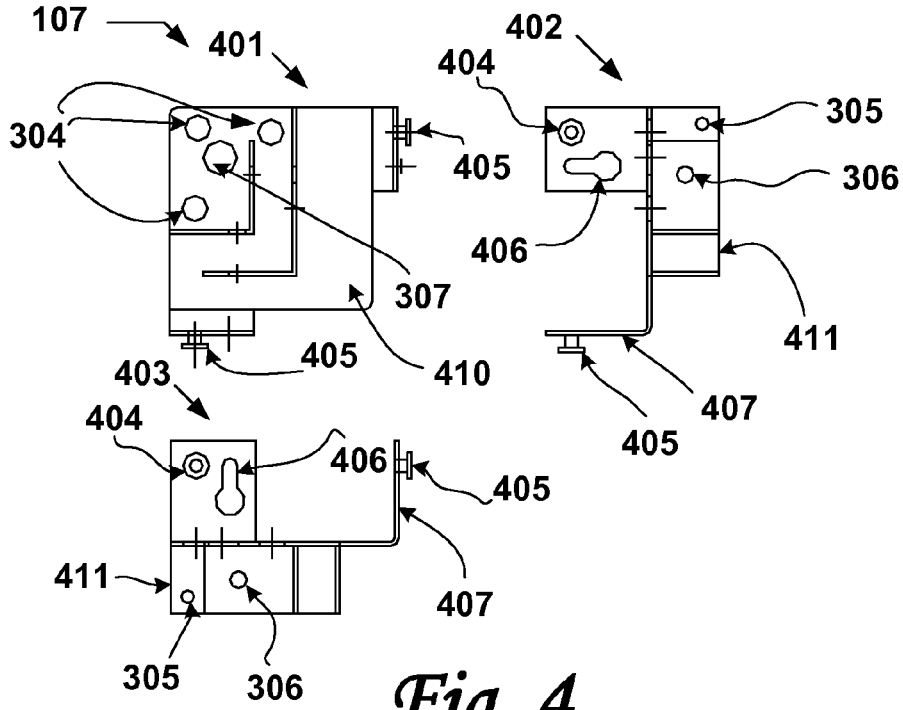
FIG. 4 is a plan view of a mount of a first type, as well as elevation views of the two vertical outer sides of the connector that may be employed in embodiments of the present invention, one of four such mounts of a first type on each of the box-shaped platform modules of FIG. 1.
Figure 12:
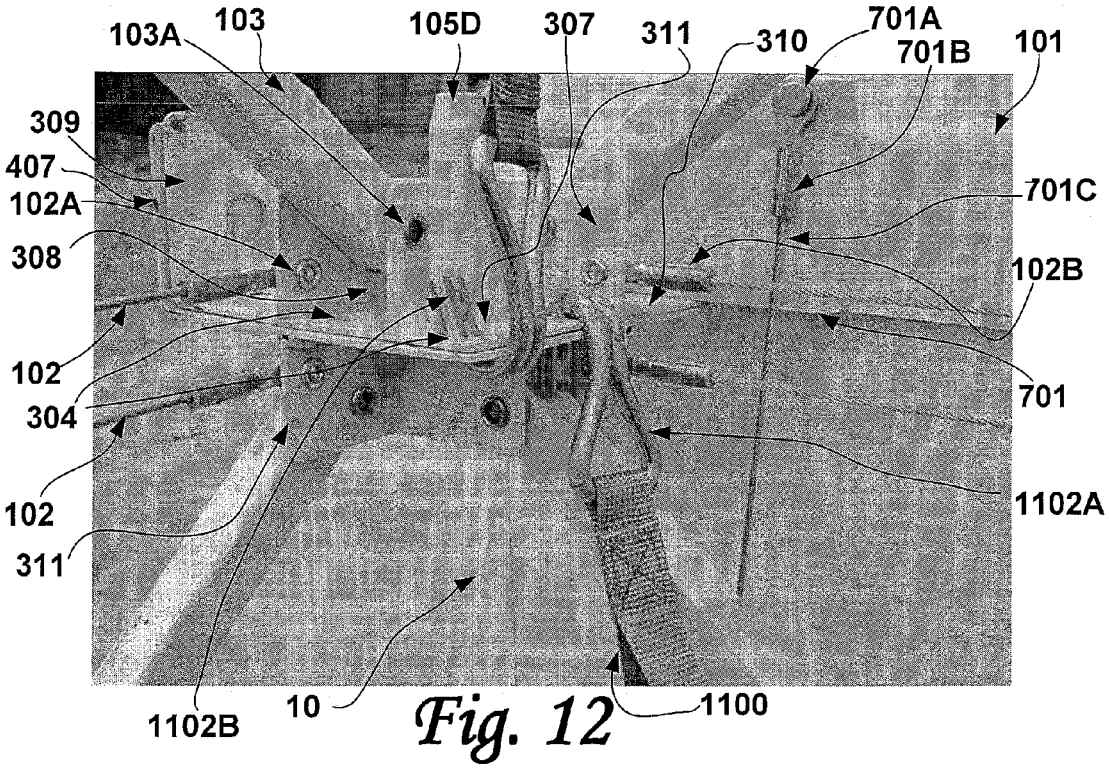
FIG. 12 depicts detail of a bottom corner of a second "story" of an embodiment of the present invention as installed for a field test.
Figure 13:
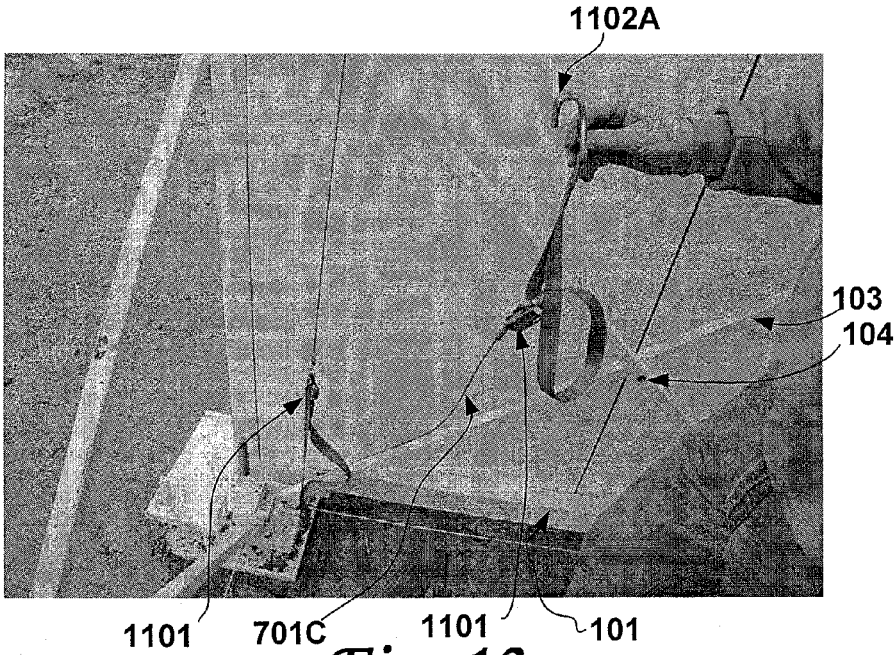
FIG. 13 shows detail of a bottom corner of a first "story" of an embodiment of the present invention as installed on a base for a field test.
Figure 16:
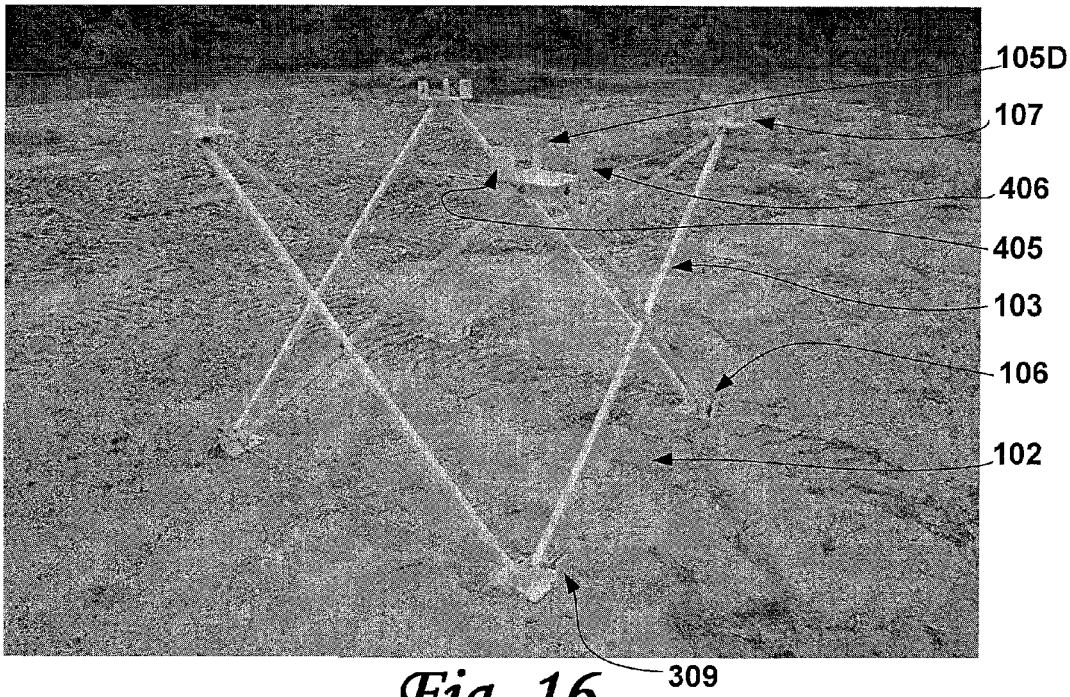
FIG. 16 shows the frame of FIG. 9 with tensioned wires installed as initially readied for placement on bases.

Refer to FIG. 1 depicting, for clarity only, an elevation view of a single box-shaped platform unit 100 and a single panel 10 installed thereon for illustration purposes only, the unit 100 as may be employed in select embodiments of the present invention. In select embodiments of the present invention, the platform 100 for holding the panels 10 comprises a number of tubular cross members 103, pairs of which are extendable to form an X pattern on each of the platform's four sides to comprise a basic backbone in compression and pairs of wires 102, located at the top and bottom of each side of the platform unit 100 and in tension between each of the parallel sides of the platform unit 100 to hold the platform unit 100 in position for accepting the panels 10. Refer to FIGS. 12, 13, and 16 . The cross members 103 are loosely pinned to permit limited pivoting on the pins 103A (FIG. 12) affixing the cross members 103 to the bottom 106 and top 107 mounts and are joined in the center by a pin 104 allowing each cross member to move in a plane to pivot in the plane of its respective side of the platform unit 100. The pinning is by suitable means, such as clevis pins or rivets, the cross members 103 fitting in two slots 308 (FIGS. 3 and 12) perpendicular one to the other, at the bottom 106 and top 107 mounts that comprise diagonally opposed corners of the platform unit 100. Likewise, in select embodiments of the present invention, the pairs of wires 102 fitted with swaged end connectors 102B (FIG. 12) are connected perpendicular to and between each of the parallel sides to end connectors 102A (FIG. 12) fitted to holes 305 in mounts 106, 107 (FIGS. 3 and 4). Note that in select embodiments of the present invention the securing tabs 309 in the bottom mount 106 and 407 in the top mount 107 may be used for z-bars 101 that hold panels in stacked platform units 100 as well as for providing the support for the bottom on a "base" platform unit 100 for the bottom mount 106 and for the bottom of a second story for the top mount 107. Likewise, the securing tabs 407 (FIGS. 4 and 12) may be used to index the top z-bars 101 in any configuration.

Figure 6:
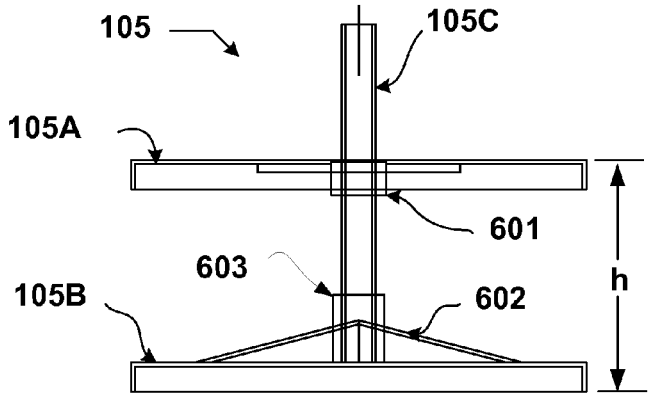
FIG. 6 shows detail of an adjustment unit that may be used with embodiments of the present invention to adjust height of individual box-shaped platform modules to match modules connected therewith.

Together with the adjustable bases (leveling pads) 105 on which the frame 800 (FIG. 8) rests at each of the four corners of the platform unit 100, panels 10 when mounted in z-bars 101 indexed to tabs 407 at the top 107 and tabs 309 at the bottom 106 mounts of the longitudinal sides of length, L, provide a degree of physical protection as specified by a user. Referring to FIG. 6, the adjustable bases (leveling pads) 105 comprise a top (or bearing) plate 105A, a bottom (or support) plate 105B, an adjusting through bolt 105C and necessary internal assemblies (not shown separtely) to support and permit one-handed adjustment of the height, h, of the adjustable base 105. The top and bottom z-bars 101 for each platform unit 100 are further secured by straps 1100 (FIGS. 11-13) that are tensioned at each end by means of tensioning means, such as ratchets 1101, affixed to holes 304 (FIGS. 3, 4, 12) in bottom 106 and top 107 mounts, respectively, at the time of installation as further explained below. In select embodiments of the present invention, the platform unit 100 is configured such that it may be disassembled and collapsed for transport as shown in FIG. 9, as discussed further below. The dimensions of length, L, width, W (FIG. 2), and height, H (FIG. 1), are chosen to permit platform units 100 of select embodiments of the present invention to be carried and assembled without the use of lifting machinery.

Figure 2:
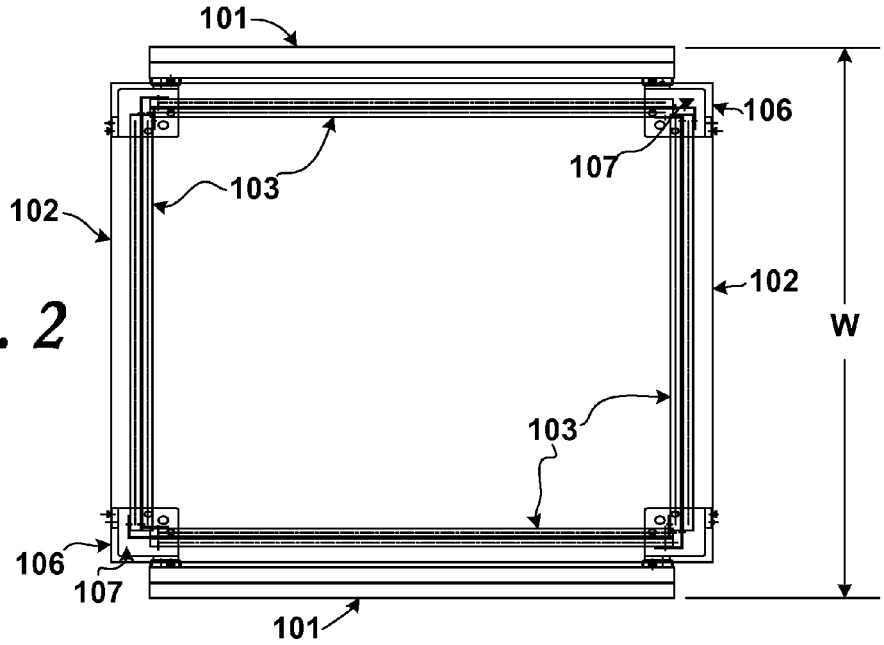
FIG. 2 is a plan view of the single box-shaped platform of FIG. 1 that may be employed in embodiments of the present invention.
Figure 7:
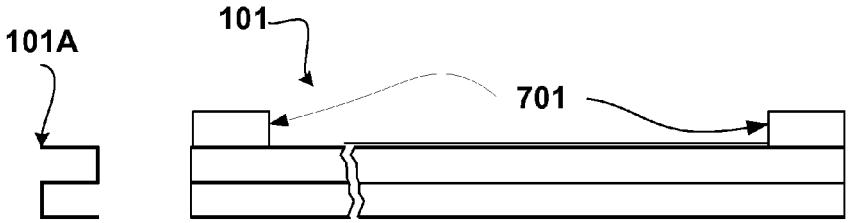
FIG. 7 shows plan and edge views of a z-bar employed to hold panels onto individual platform modules that may be used in embodiments of the present invention.
Figure 14:
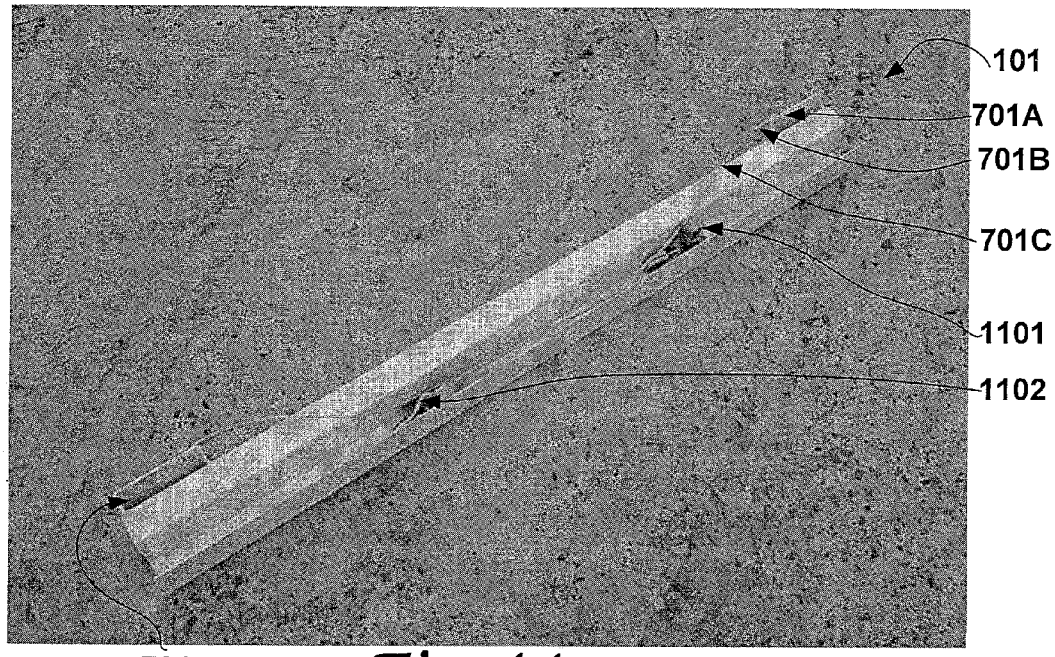
FIG. 14 shows a z-bar of an embodiment of the present invention as it would be configured for storage or shipping.
Figure 21:
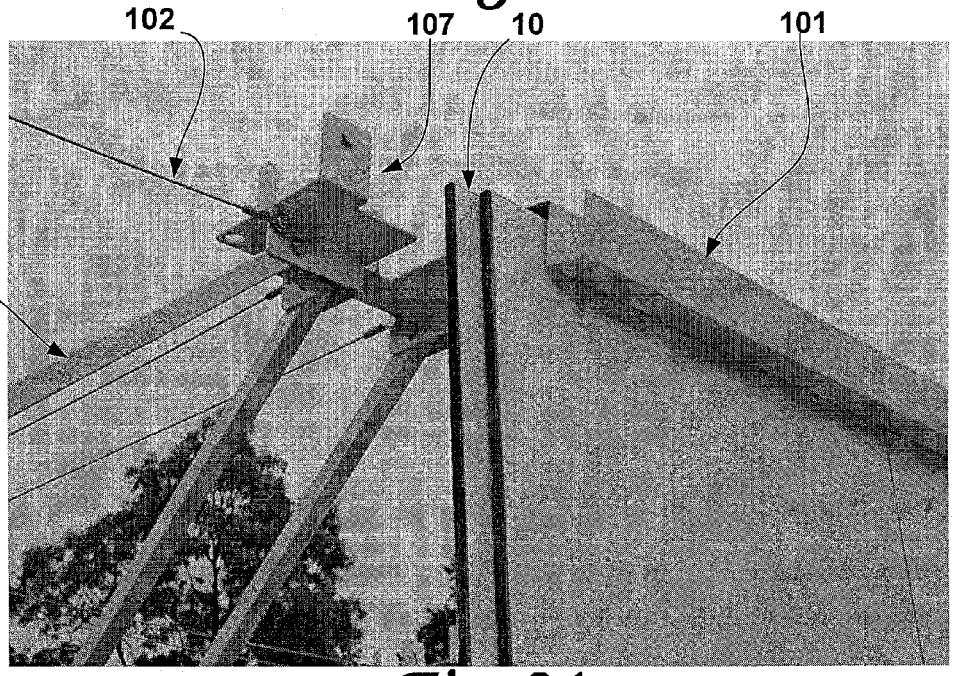
FIG. 21 shows two overlapping panels as fitted within a "top" z-bar as a barrier of an embodiment of the present invention is being constructed.
Figure 22:
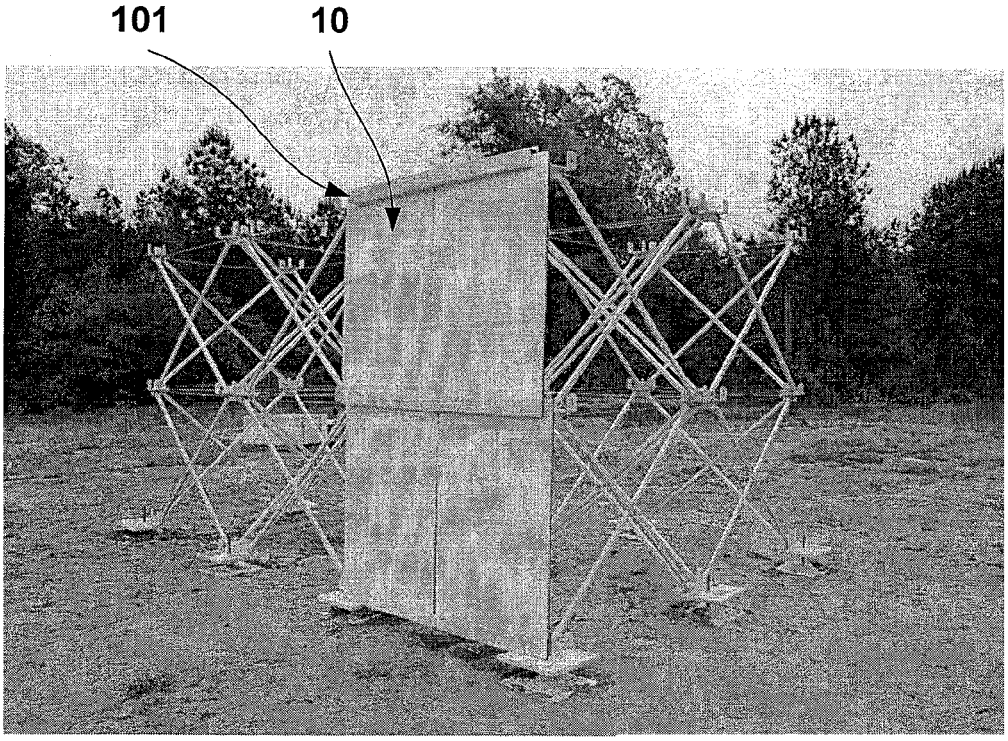
FIG. 22 depicts a single layer of panels in a corner of a two story barrier as it is being constructed, clearly showing how a top z-bar of the bottom "story" serves as the bottom z-bar of the second "story" in an embodiment of the present invention.

Refer to FIG. 2, a top view of the platform unit 100 of FIG. 1 without the adjustable bases 105, shown for clarity only, as may be employed in embodiments of the present invention. The top and bottom z-bars 101 are evident along the length, L, of the platform unit 100 as fitted onto tabs 407 (FIG. 4), 309 (FIG. 3), respectively, parallel to the length, L, and along the outside edge of the top 107 and bottom 106 mounts. Refer to FIG. 7 for a side view and FIG. 14 for a profile view of the slotted configuration 701 that slips over the tabs 309, 407. Also evident in FIG. 2, are the top tensioning wires 102 of the frame 800 (FIG. 8) as readily seen running parallel to the width, W, of the platform unit 100. Note that, although not evident in FIG. 2, a set of tensioning wires 102 also runs along the bottom of each of the four sides, L and W, and the top of sides, L. Refer to FIGS. 22-23 and note also that, in select embodiments of the present invention, the z-bars 101 do not extend to the end of the sides, L, although emplaced panels 10 may since the z-bars 101 have open-ends. Refer to FIG. 21 in which for select embodiments of the present invention,multiple panels 10 may be emplaced one upon the other in the slots of the z-bars 101 to create a greater thickness, preferably in such a manner as to cover the intersection between panels 10 in the layer below. In select embodiments of the present invention, a different thickness (either single panels of different thickness or a total overlaid number of panels 10 each of which may be the same thickness) may be used on each side, L, depending on a user's requirements.

Figure 17:
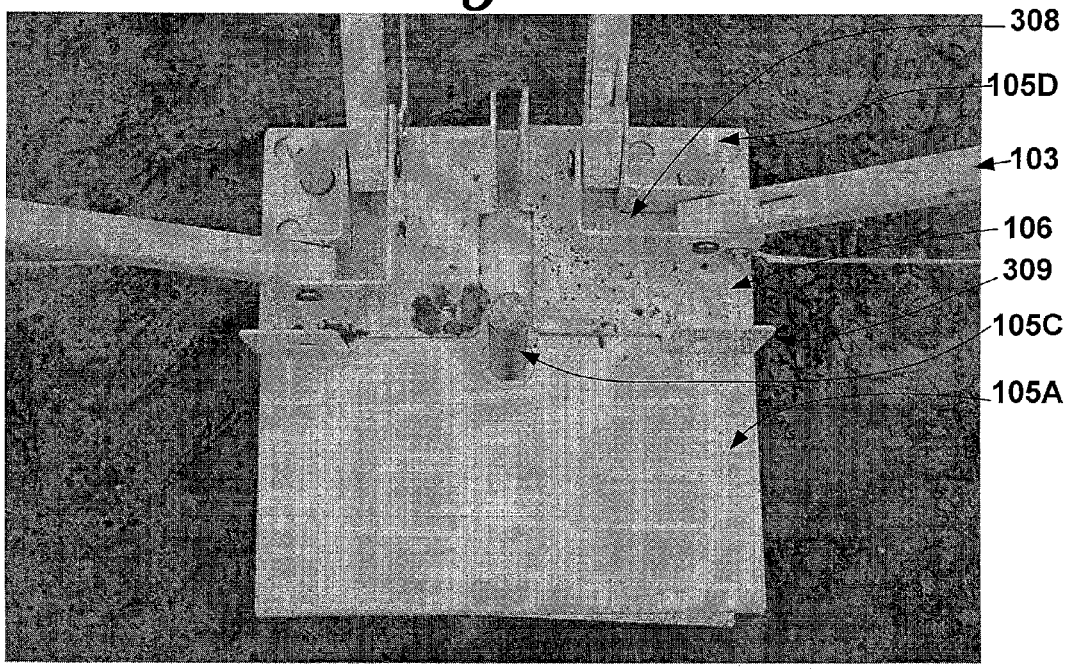
FIG. 17 depicts bottom corners of two frames of FIG. 16 as joined on a base when installing a horizontal section of barrier of an embodiment of the present invention.

Refer to FIG. 3, showing a top view 301 of a bottom mount 106, as well as elevation views 302, 303 of the two outer sides of the bottom mount 106 that may be employed in embodiments of the present invention, one of four such bottom mounts 106 on the platform unit (module) 100 of FIG. 1. Refer to FIG. 17 showing two bottom mounts 106 as mounted on a base 105 as may be used in an embodiment of the present invention and FIG. 12 showing a top mount 107 joined to a bottom mount 106 to construct a second story for the barrier. In the top view 301, the opening 307 is for a pin or rod 105D (FIG. 17) (not shown separately) to both align and join the bottom mount 106 to either an adjustable base 105 as in FIG. 17) or a top mount 107 as in FIG. 12) of a stacked frame 800 platform unit 100 when extending the height of an installation of frames 800 platform units 100. Also shown are openings 304 in the base 310 of the bottom mount 106 that may be used for affixing one end 1102 (FIG. 11) of an adjustment strap 1100 from a z-bar 101 to a mount 106, 107 in the same side to which the z-bar 101 (attached to the other end of the adjustment strap 1100) is not indexed. FIG. 12 shows one end 1102A of the strap 1100 through opening 304 in overlapped top 107 and bottom 106 mounts, the other end affixed to the bottom z-bar. FIG, 12 also shows an end 1102B through opening 304, the other end of the strap 1100 affixed to an uppermost z-bar 101 designating the top of the second story of the barrier. The base 310 of the bottom mount 106 is shown with a channel 308 (see also FIG. 17) for securing at right angles two of the cross members 103 therein by means of pins 103A (FIG. 12) (not shown separately) through holes 306 in the sides of the channel 308 as seen in the elevation views 302, 303 and FIG. 12. The pins 103A are loosely fitted, permitting the pivoting of the cross members 103 in the plane paralleling the securing tabs 311, i.e., along the edge of the platform unit 100 in which the cross member 103 lies. For the bottom mounts 106, the securing tabs 309 are folded (bent) in the same direction as the securing tabs 311 for affixing the cross members 103 and tension wires 102. One of the securing tabs 309 also serves as an indexing tab 309 for the z-bars 101, fitting the slots 701 (best viewed in the perspective view of FIG. 147) thereof. In select embodiments of the present invention, the tabs 309 are perpendicular one to the other and present on the outer sides of the base 310 of the bottom mount 106 to further permit installation of platform units 100 at right angles to one another as necessary.

Figure 10:
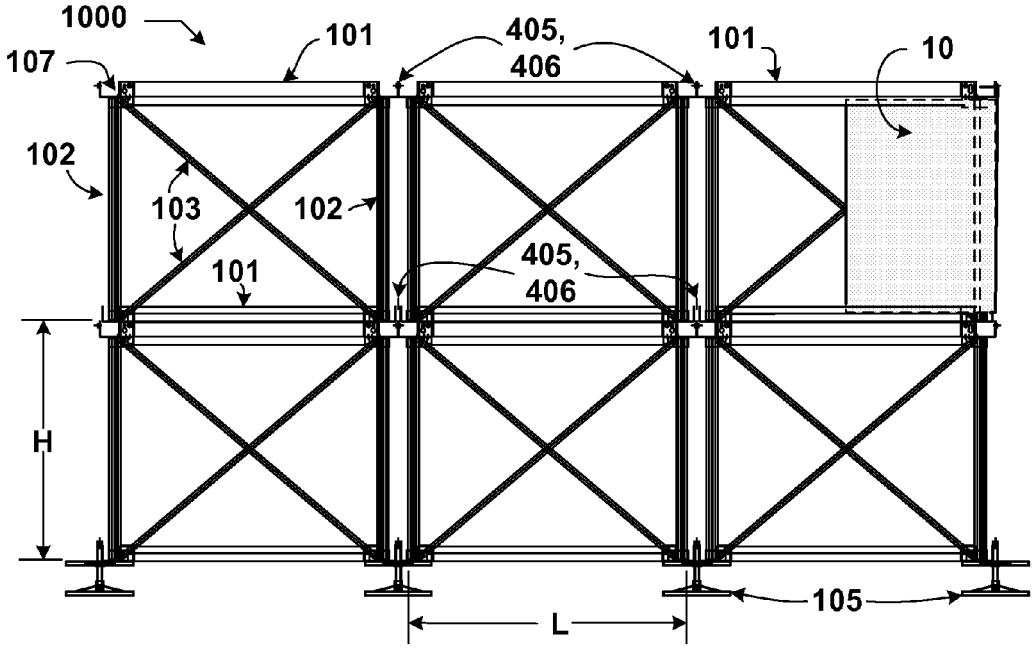
FIG. 10 is an elevation view of one side of a box-shaped wall comprising three long by two high interconnected box-shaped platform modules that may be employed in embodiments of the present invention, and a single installed panel thereon for illustration purposes only.

Refer to FIG. 4, a top view 401 of a top mount 107, as well as elevation views 402, 403 of the two outer sides of the top mount 107 that may be employed in embodiments of the present invention, one of four such top mounts 107 on the platform unit 100 of FIG. 1. In select embodiments of the present invention, although similar to the bottom mounts 106 with respect to all aspects including the two securing tabs 407 arising from the base 410, the top mounts 107 have connection tabs 411 on the opposite side of the base 410 from the two securing tabs 407. This arrangement facilitates mating the bottom 106 and top 107 mounts to permit vertical stacking of the platform units 100. The top mounts 107 also incorporate a rivet 405 and slot 406 arrangement in the two securing tabs 407, a rivet on one tab 407 and a slot on the other tab 407 in each mount 107. The rivet 405 and slot 406 arrangement is provided for securing individual platform units 100 one to another at their respective tops, i.e., the two securing tabs 407 are perpendicular to each other on opposing corners of each of the top mounts 107. Further, the orientation of the rivet 405 and slot 406 arrangement of the top mounts 107 is reversed at opposite ends of the platform unit 100 to permit connection of adjacent platform units 100. That is, in select embodiments of the present invention, the top mounts 107 are specifically configured to fit to the bottom mounts 106 so as to permit stacking of the platform units 100 to make a high protective barrier, an example of which is shown in FIG. 10, and the perspective views of FIGS. 12 and 23, stacked two high.

Figure 5:
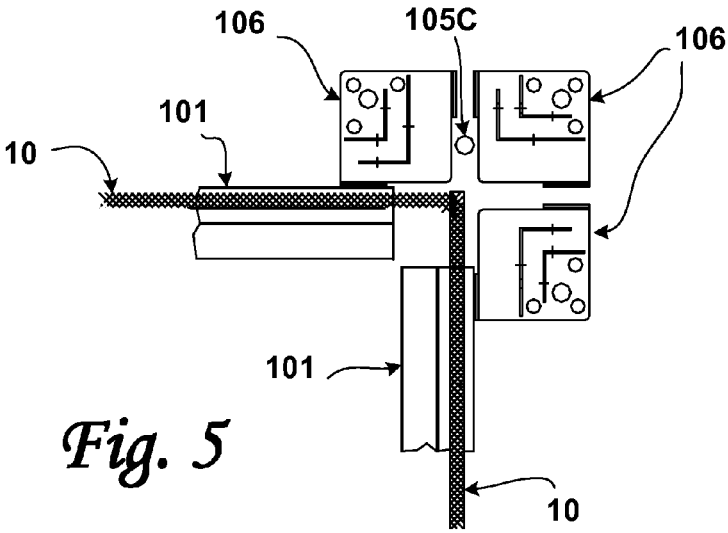
FIG. 5 illustrates how a corner is formed using box-shaped platforms of embodiments of the present invention and panels.

Refer to FIG. 5, shown for clarity only, a cross section taken through the bottom of abutting corners of three platform units 100. FIG. 5 depicts a top view of the three bottom mounts 106. FIG. 5 illustrates how in select embodiments of the present invention a corner is formed using three platform units 100, only two of which are shown with a panel 10 installed in the z-bars 101. Note the threaded adjustment rod 105C shown to indicate the position of the adjustable base 105 in relation to the three bottom mounts 106.

Figure 15:
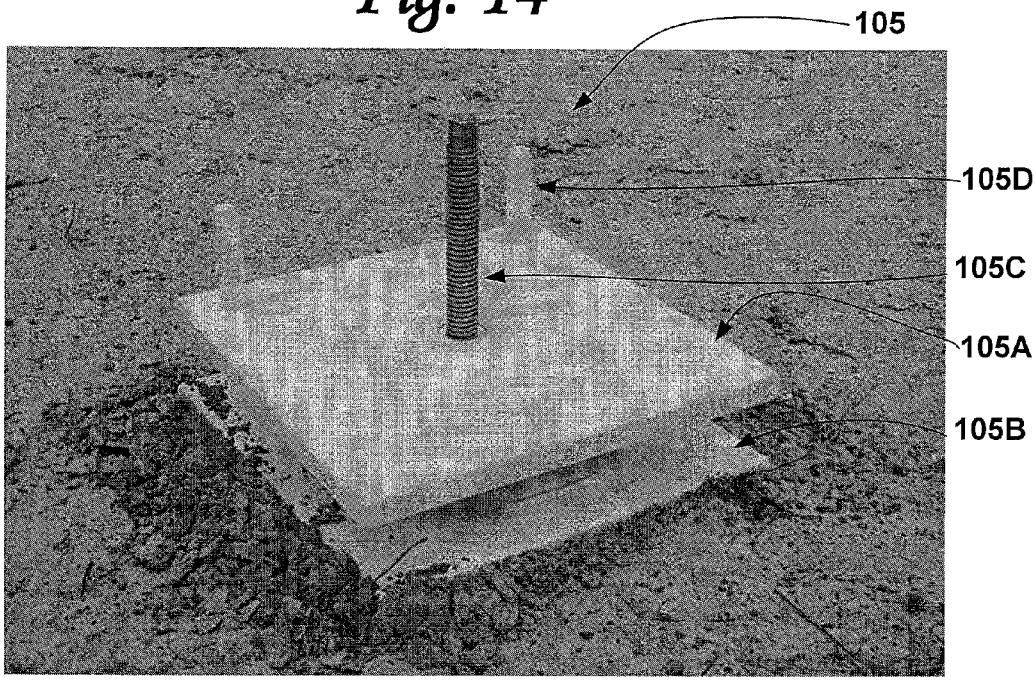
FIG. 15 depicts a base of an embodiment of the present invention as initially emplaced for a field test.
Figure 18:
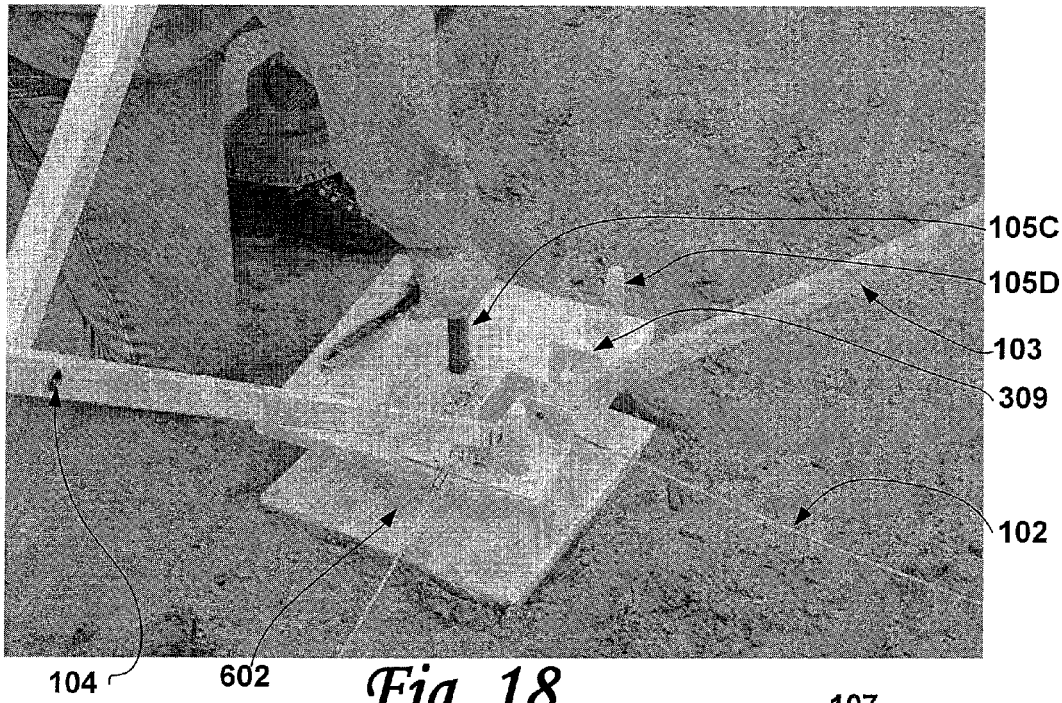
FIG. 18 demonstrates how a frame of FIG. 16 is leveled via adjustment of a bottom base for an embodiment of the present invention.

Refer to FIG. 6, an elevation view of an adjustable base unit 105 that may be used with embodiments of the present invention to adjust the height of frames 800 of individual platform units 100 to match platform units 100 connected therewith. Refer also to FIG. 15, a perspective view of an adjustable base unit 105 that may be used with embodiments of the present invention as emplaced in readiness for construction of a barrier and FIG. 18 a perspective view of an adjustable base unit 105 that may be used with embodiments of the present invention connected to one frame 800 as the base unit 105 is being adjusted to level the frame 800. In select embodiments of the present invention, a threaded rod 105C with an appropriate end nut (not shown separately) for applying a socket wrench or the like, is threaded through a threaded collar 601 in a rest (top) plate 105A on which a corner of a frame 800 of a platform unit 100 rests. The support base (bottom plate) 105B for the adjustable base unit 105 is of the same general dimensions as the rest plate 105A, further including a collar 603 reinforced via a ramped configuration 602, the collar 603 for receiving and supporting the threaded rod 105C.

Refer to FIG. 7 showing top 101 and end 101A views of a z-bar 101 employed to hold panels 10 onto individual platform units 100 as may be used in embodiments of the present invention. Note the slot configurations 701 added to the z-bars 101 for indexing the z-bars 101 to the tabs 309, 407 at the bottom and top of platform units 100, respectively.

Figure 8:
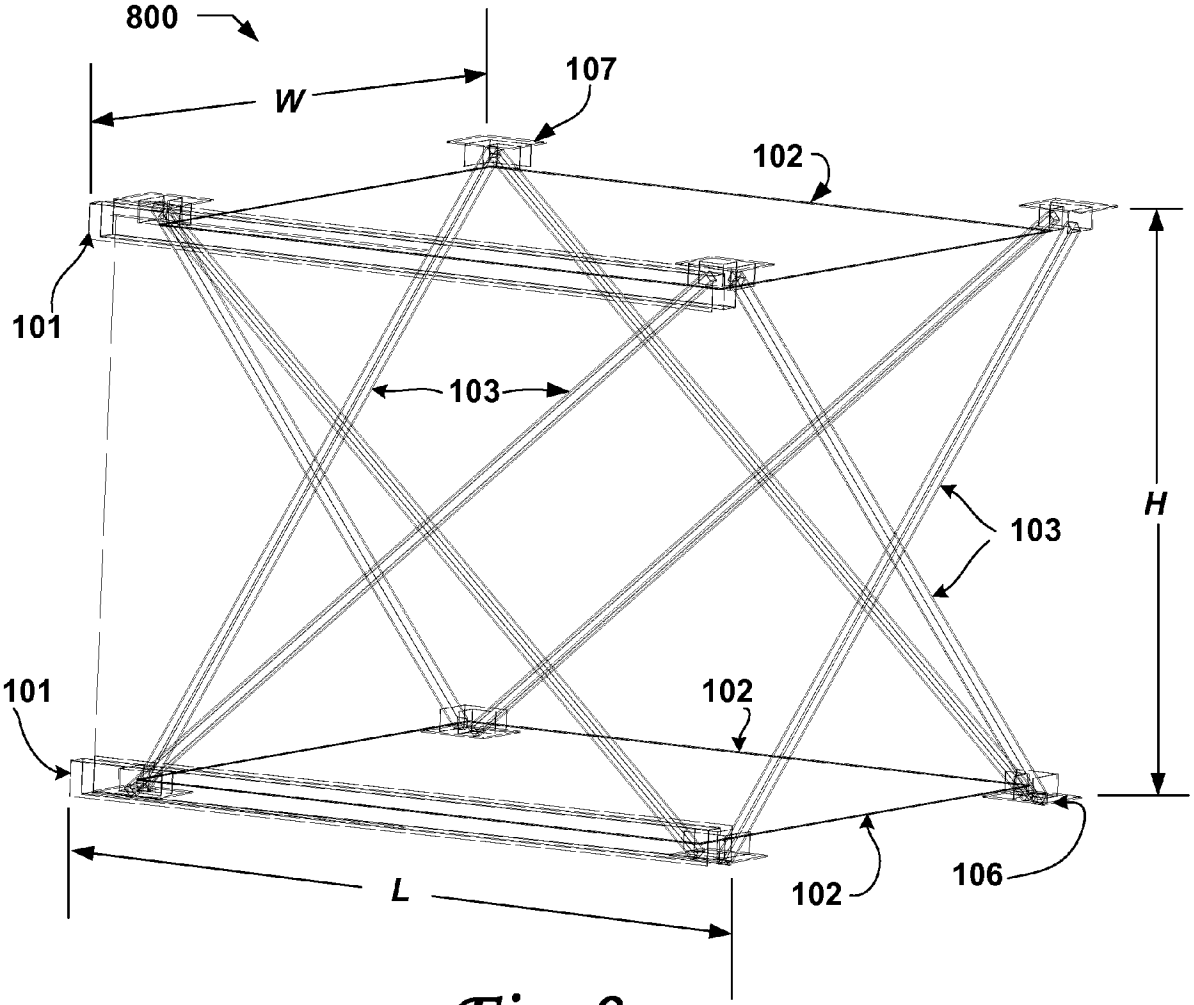
FIG. 8 is a perspective of the basic structure of a box-shaped platform module expanded for installation of panels, to include z-bars, members in compression and members in tension and mounts that may be used with embodiments of the present invention.
Figure 9:
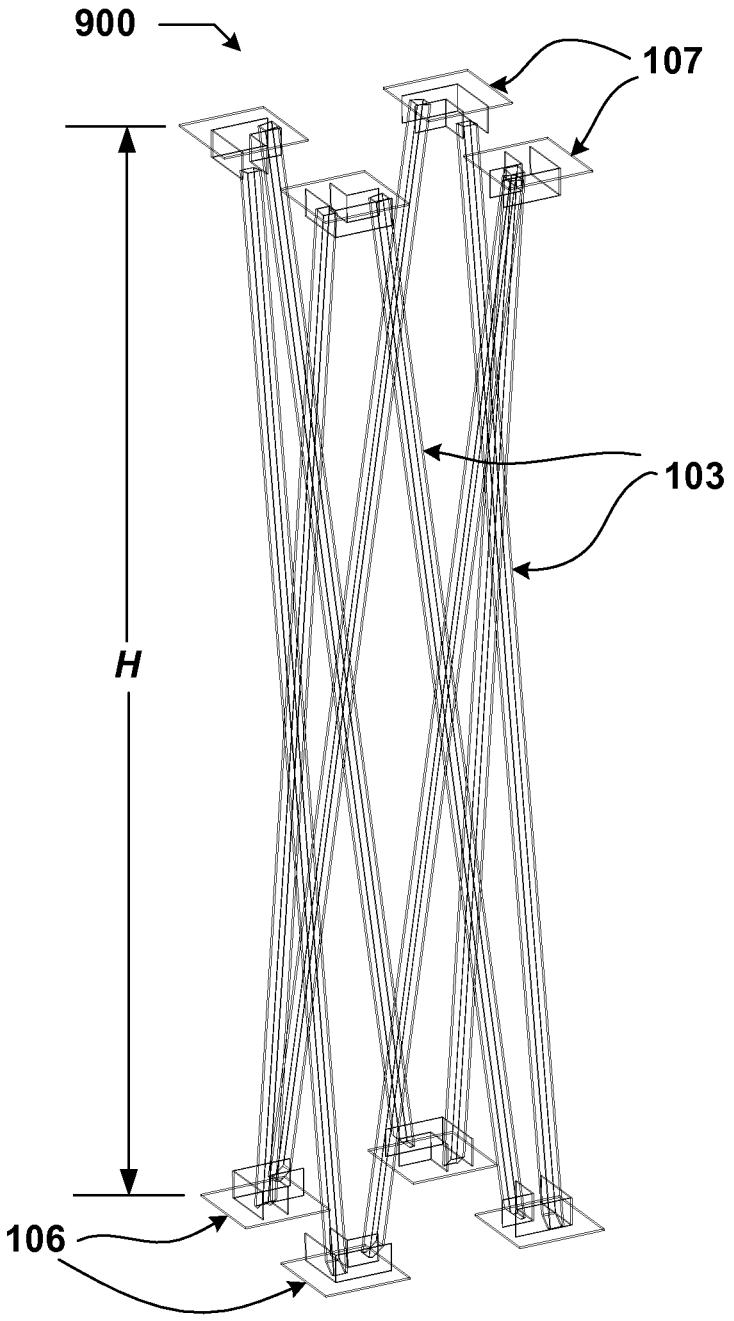
FIG. 9 is a perspective of the basic structure of a platform module collapsed for transportation or storage without z-bars and members in tension that may be used with embodiments of the present invention.

Refer to FIG. 8, a perspective of the basic frame 800 of a platform unit 100 expanded for installation of z-bars 101 and panels 10 (not shown separately in FIG. 8), to include z-bars 101, members in compression 103 and tension 102 and top 107 and bottom 106 mounts that may be used with embodiments of the present invention. Note that, in select embodiments of the present invention, z-bars 101 and consequently panels 10 may be installed only on one longitudinal side, L, in some applications, while in other applications, the panels are installed on both longitudinal sides of a platform unit 100. Further, double thicknesses of panels 10, (as shown in perspective view in FIG. 21), i.e., panels placed one on top of the other, may be installed in the z-bars 101 on one side, L, while a single panel is installed in the z-bars 101 on the opposing side, L, in some applications. Normally, no z-bars 101 and thus, no panels 10, are installed along the width, W, of the platform units 100. Rather, the configuration of FIG. 5 is used to change direction of the resultant barrier.

Refer to FIG. 9, as depicted for clarity only, a perspective of the basic structure 900 of a platform unit 100 collapsed for transportation or storage, without z-bars 101 and members in tension (wires) 102, as may be used in select embodiments of the present invention. The necessity for loose fittings of the pins in the top 107 and bottom 106 mounts as well as at the tie pin 104 shown in perpective view in FIG. 13) at the mid-connection of cross members 103 in each side of the frame 800 of the platform units 100 is evident from FIG. 9, a frame 800 without members in tension 102 that is collapsed for storage or transport.

Figure 19:
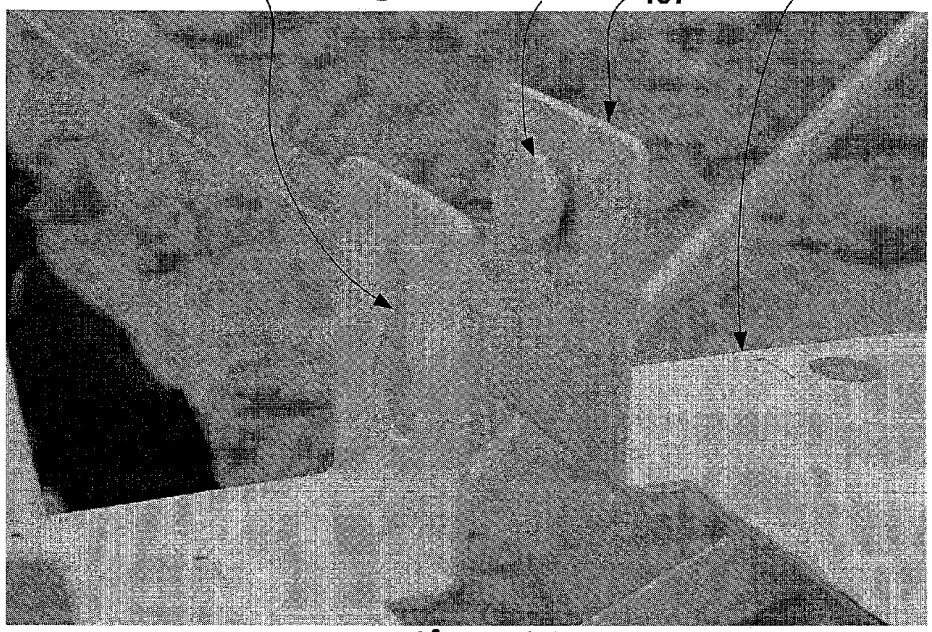
FIG. 19 shows detail of a means of connecting two frames of FIG. 16 at a top mount of each frame for an embodiment of the present invention.
Figure 20:
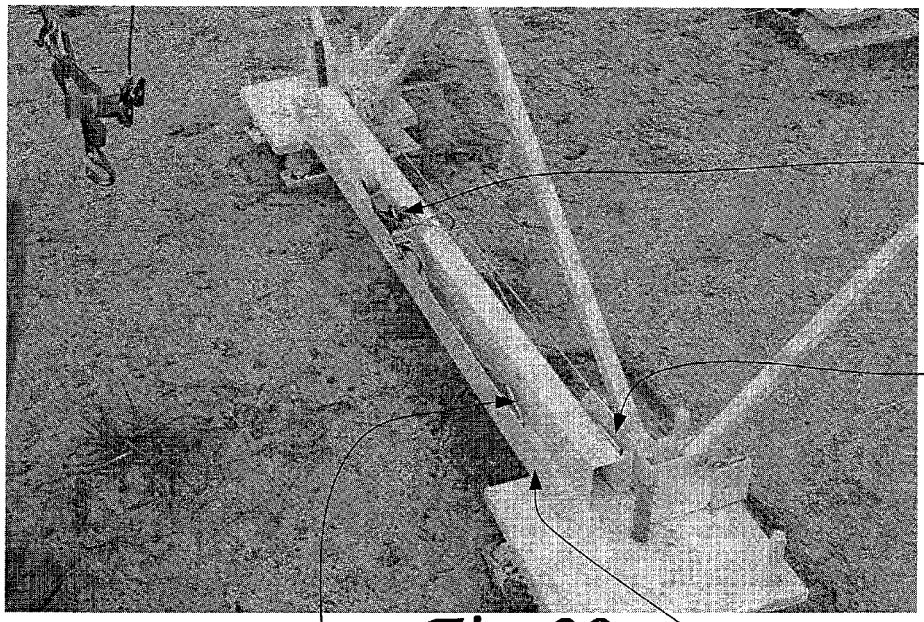
FIG. 20 depicts a z-bar of an embodiment of the present invention as first placed on the frame of FIG. 16.

Refer to FIG. 10, an elevation view of one side of a protective wall 1000 comprised of box-shaped platform units 100 of select embodiments of the present invention. The section of wall 1000 comprises three long by two high interconnected platform units 100 and a single installed panel 10 thereon, the latter depicted for illustration purposes only. Note that the bottom of each platform unit 100 is "secured" to its neighbor by a common adjustable base unit 105 while the rivet 405 and slot 406 arrangement (see FIG. 19 for perpective view) available at the top mount 107 of each platform unit 100 secures the individual platform units 100 to each other at their respective tops.

Figure 11:
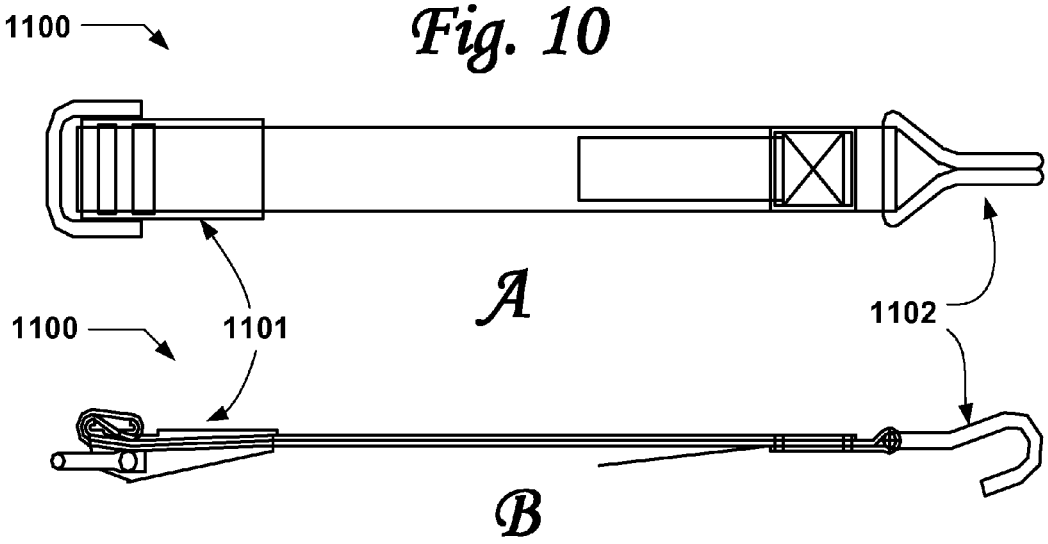
FIG. 11 shows plan and elevation views of a strap that may be employed to constrain the z-bars in the box-shaped platform modules of an embodiment of the present invention after installation of the panels in the z-bars.

Refer to FIG. 11, showing top A and elevation B views of a strap 1100 that may be employed to tighten a wire 701C (FIGS. 12, 13) having a swaged connector 701B for fastening to a button 701A incorporated in a z-bar 101 as used to secure the z-bars 101 as installed with inserted panels 10 in the platform units 100 of an embodiment of the present invention. Refer to FIG. 12 for perpective views of the strap 1100 as installed at the intersection of one basic frame 800 placed on top of another and to FIG. 13 for a perspective view of a strap 1100 being installed on a ground level basic frame 800. The strap 1100 comprises a hook 1102 at one end for inserting in holes 304 (see FIG. 12 for a perspective view) in the top 107 or bottom 106 mounts, or both, as appropriate and a ratchet 1101 (see FIG. 18 for a perspective view) at the other end for tensioning the wire 701C attached to the strap 1100 and one of the holes 304 in the top 107 or bottom 106 mount, or both as shown in FIG., 12, as appropriate. In select embodiments of the present invention, the wire 701C attached to the strap 1100 is pre-attached one to each end of a z-bar 101 to facilitate shipping and installation of the z-bars 101 on the platform units 100. Refer also to FIG. 22 showing a perspective view of a single layer of panels in a corner of a two story barrier as it is being constructed, clearly showing how a top z-bar of the bottom "story" serves as the bottom z-bar of the second "story" in an embodiment of the present invention.

In select embodiments of the present invention all modules (components) used in constructing a protective wall or enclosure are man portable, i.e., no specialized mechanical equipment is required for handling, packaging for transport, or installing the components into a finished protective configuration.

The abstract of the disclosure is provided to comply with the rules requiring an abstract that will allow a searcher to quickly ascertain the subject matter of the technical disclosure of any patent issued from this disclosure. 37 CFR §1.72 (b). Any advantages and benefits described may not apply to all embodiments of the invention.

While the invention has been described in terms of some of its embodiments, those skilled in the art will recognize that the invention can be practiced with modifications within the spirit and scope of the appended claims. For example, although the system is described in specific examples for use in protecting assets, it may be used for any type of portable structure where physical or visual restriction or even noise suppression is desired. Thus select embodiments of the present invention may be useful in such diverse applications as mining, logging, construction, outdoor concerts, parades, and the like. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Thus, it is intended that all matter contained in the foregoing description or shown in the accompanying drawings shall be interpreted as illustrative rather than limiting, and the invention should be defined only in accordance with the following claims and their equivalents.

We claim:

1. A support for a configuration providing protection from airborne projectiles comprising:

a quadrilateral frame with an open top and an open bottom, comprising:

one each quadrilateral mount of a first type comprising:

an L-shaped channel along one corner of said mount of a first type, said L-shaped channel oriented to point toward a surface upon which said frame is placed;

first and second indexing tabs, each said tab parallel to a respective leg of said L-shaped channel, on opposing corners of said mount of a first type and oriented to point away from a surface upon which said frame is placed;

at least said mount of a first type incorporated at each of four corners of said frame and establishing extremities of said open top, one each mount of a second type at each of said four corners that establish extremities of said bottom, said mount of a second type mirroring said L-shaped channels and said first and second indexing tabs of said mount of a first type to allow said mount of a first type to connect to said mount of a second type to allow said configuration to be built in multiple vertical layers of said frames;

at least one first arrangement for indexing said mount of a first type to said mount of a second type when using said frame to add an upper layer of frames to a structure with an existing lower layer of frames;

at least one second arrangement for connecting said mount of a first type to an adjacent said mount of a first type to extend the horizontal length of said configuration;

a pair of cross members in compression on each of said four sides of said frame, each said cross member establishing a diagonal connection between a said mount of a first type and a said mount of a second type, wherein each said cross member of said pair is pivotally joined at its center to the center of said other cross member of said pair, and wherein each said cross member is pivotally joined to one said mount of a first type and one said mount of a second type to allow pivoting of said pair of cross members in a plane parallel to said side containing said pair of cross members; and at least first and second members in tension on each said side, ends of one said first member in tension attached horizontally to each said mount of a first type in each said side and ends of one said second member in tension attached horizontally to each said mount of a second type in each said side;

at least one pair of z-bars, each said z-bar comprising integral open channels facing opposite directions to permit inserting protective panels therein and slots formed at each end on one side of said z-bar for indexing said z-bar to said frame, each said z-bar incorporating an adjustable tensioner on each end located so as to be behind any installed said protective panels, wherein said z-bars are horizontally affixed along at least a first longitudinal side of said frame, each end of a said first z-bar of said pair affixed to one of two said mounts of a first type at the extremities of the top of said first longitudinal side and each end of a said second z-bar of said pair affixed to one of two said mounts of a second type at the extremities of the bottom of said first longitudinal side; and four adjustable bases indexed to each bottom corner of said frame via at least one first type of rod in each said base that mates with an opening in said mount of a second type as employed when said mount of a second type is incorporated on said frame used as a bottommost frame in said configuration, wherein each said base is in operable communication both with at least one each said mount of a second type and a surface upon which said bases rest; and wherein each said base may accommodate up to at least three said mounts of a second type in forming said configuration.

2. The support of claim 1 in which said leveling base are adjustable at least in height.

3. The support of claim 2 in which each said base further comprises:

a bottom plate configured to accept a non-threaded end of a second type of rod having a threaded portion; and a top plate configured to accept said threaded portion of said rod of a second type in a matching threaded bearing in the center of said top plate, wherein said rod is in operable communication with said bottom plate and said top plate and configured to be rotated and moved in relation to said top plate for adjusting the height of said frame.

4. The support of claim 1 in which all components of said configuration are man transportable and at least some said components comprise at least steel having at least a corrosion resistant finish.

5. The support of claim 1 in which the length is equal to the width which is equal to the height of said frame.

6. The support of claim 1 in which said z-bars comprise integral first and second open rectangular channels, the open portion of a first said channel facing to said top and the open portion of a second said channel facing to said bottom of said configuration, said channels incorporating open ends, said z-bars much longer in length than either width or depth.

7. The configuration of claim 1 in which said members in tension comprise at least wires, one said wire along each side of said frame at the top of said frame and one said wire along each side of said frame at the bottom of said frame, wherein, for each said frame, four said wires are employed with said mounts of a first type and four said wires are employed with said mounts of a second type.

8. The support of claim 1, said frames foldable to facilitate storage and transport.

9. A method establishing support for a modular configuration, comprising:

a) providing and unfolding a quadrilateral frame module with an open top and an open bottom, comprising:

one each mount of a first type at each of four corners of said module establishing extremities of said top;

one each mount of a second type at each of said four corners establishing extremities of said bottom, wherein said mount of a first type is connectable to said mount of a second type on another said module to permit vertical stacking of said frame modules, and wherein said mount of a first type is connectable to an abutted said mount of a first type to permit horizontal connection of said frame modules one to another;

a pair of cross members in compression on each of said four sides of said frame module, each said cross member establishing a diagonal connection between a said first type of mount and a said second type of mount, wherein each said cross member of said pair is pivotally joined at the center to the other said cross member of said pair, and wherein each said cross member is pivotally joined to one said mount of a first type and one said mount of a second type to allow pivoting of said pair of cross members in a plane parallel to said side containing said pair of cross members; and at least first and second members in tension on each said side, ends of one first member in tension attached horizontally to each said mount of a first type in each said side and ends of one second member in tension attached horizontally to each said mount of a second type in each said side;

b) providing at least one pair of z-bars comprising integral open channels facing opposite directions and raised slots at each end on one side for indexing said z-bar to said module, each said z-bar incorporating an adjustable tensioner at each end, affixing said z-bars along at least a first side of said frame module by indexing each end of a first z-bar of said pair to one of two said mounts of a first type at the extremities of the top of said first side and indexing each end of a second z-bar of said pair to one of two said mounts of a second type at the extremities of the bottom of said first side;

c) providing four leveling pads;

d) placing said pads on a level surface spaced to approximate the spacing of the four corners of a said frame module;

e) indexing each said pad to each bottom corner of a first said module via at least one first type of rod incorporated in each said pad that mates with an opening in said mount of a second type, wherein each said pad is in operable communication both with at least one each said mount of a second type and a surface upon which said pads rest; and wherein said second type of mount is connectable to said leveling pad when said second type of mount is employed in modules that are a base of said configuration, and wherein said pads may accommodate up to at least three said mounts of a second type;

f) providing two additional said pads per a second and each succeeding said frame module to be connected to existing installed said modules to comprise said modular configuration, each said addition of said second and succeeding frame modules comprising:

1) repeating steps (a) and (b);

2) placing said two pads on a level surface, spaced to approximate the spacing of two of the four corners of an additional said frame module to be abutted to said installed frame module;

3) indexing each of two said pads employed in installing said installed frame module to each mount of a second type on the side of said additional frame module abutting said first frame module and in a similar manner indexing said additional two pads to remaining said mounts of a second type on said additional frame module;

4) adjusting the height of said leveling pads now associated with said additional frame module to permit connection of said mounts of a first type on the abutting sides of said installed and additional frame modules to be connected together and approximately level;

5) providing panels having a length, width and depth;

6) mounting said panels on at least one said side of said configuration in each said pair of z-bars in each said frame module incorporated in said configuration as a base of said configuration;

7) checking openings between installed panels, 8) re-adjusting the height of said installed modules to minimize any said openings above a pre-specified value;

9) setting tension of said adjustable tensioners to a pre-specified value;

and g) repeating step a) -f) until a pre-specified length of said configuration is established.

10. The method of claim 9 further comprising installing said panels on two opposing longitudinal sides of said configuration.

11. The method of claim 9 further comprising installing overlapped said panels on at least one said side of said configuration.

12. The method of claim 9 connecting said mounts of a first type via fitting rivet heads on a first abutting said frame module to rivet slots on a second abutting said frame module.

13. The method of claim 9 stacking additional said frame modules directly upon first installed said modules to increase the height of said configuration, further comprising:

a) providing and unfolding at least one said quadrilateral frame module;

b) providing at least one said z-bar;

c) indexing a first said z-bar along at least a first side of said frame module, affixing each end of said first z-bar to one of two said mounts of a first type at the extremities of the top of said first side;

d) indexing each said mount of a first type on said installed frame modules to a below corresponding said mount of a second type on said additional stacked frame module via said at least one first type of rod;

e) adjusting the height of said leveling pads now associated with abutting said stacked frame modules to permit approximately level connection of said mounts of a first type on the abutting sides of said stacked frame modules;

f) providing said panels;

g) mounting said panels on at least one said side of said stacked frame modules;

h) checking openings between all said installed panels, i) re-adjusting the height of said installed frame modules to minimize any said openings above a pre-specified value;

j) setting tension of said adjustable tensioners of said z-bars affixed to said stacked frame modules to a pre-specified value; and k) repeating steps (a) - (j) until a pre-specified length of said configuration is established.

14. The method of claim 13 further comprising installing a second said z-bar on said side opposing said side on which said first z-bar is placed and installing said panels using said second z-bar.

15. The method of claim 13 further comprising installing overlapped said panels on at least one said side of said stacked frame modules.

16. Support for a transportable configuration that provides protection for assets, comprising:

a stackable frame open at the top and bottom of said frame, said frame having four sides and eight corners, comprising:

first and second type mounts at each of said eight corners of said frame, four said mounts of a first type located at said top of said frame, one at each corner, said mounts of a first type comprising in part an L-shaped channel along one corner for securing members having a quadrilateral cross section, the open side of said L-shaped channel oriented to point toward a surface upon which said frame is placed, first and second indexing tabs pointing away from said surface, each said indexing tab on opposing corners of said mount of a first type and parallel to a respective leg of said L-shaped channel and four said mounts of a second type located on the four corners at said bottom of said frame, said mounts of a second type mirroring said L-shaped channels of said mount of a first type by having said open side of said L-shaped channels oriented opposite those of said mounts of a first type to allow said mount of a first type to index to said mount of a second type, thus allowing said configuration to be built in multiple vertical layers of said frames;

at least one third indexing arrangement incorporated in said mount of a second type permitting mating to said mount of a first type when using said frame to add an upper layer of said frames to a structure with an existing lower layer of said frames;

wherein each said mount of a first type on a first frame is configured to allow connection to another said mount of a first type that is a part of a second said frame abutting said first said frame to allow horizontal connection of said frames one to another;

a pair of cross members in compression on each of said four sides of said frame, each said cross member of said pair pivotally joined at its center to the center of the other said cross member of said pair and pivotally joined to one said mount of a first type and one said mount of a second type diagonally opposite said mount of a first type on the same side of said frame so as to allow pivoting of said pair of cross members in one plane parallel to said same side; and at least first and second members in tension positioned on each of said four sides of said frame, said first member horizontally attached to respective said mounts of a first type and said second member horizontally attached to respective said mounts of a second type;

at least first and second z-bars, each said z-bar comprising two abutting open channels facing opposite directions to create a "z" when viewed from an end, an installed pair of said z-bars allowing inserting protective panels therein, said z-bars incorporating raised slots formed at each end on one side of said z-bar that allow indexing said z-bar to said frame, each said z-bar incorporating first and second tensioning wires, each in operable communication with an adjustable tensioner, said tensioning wires connected on each said formed slot so as to be behind any installed said protective panels, said z-bars horizontally indexed along at least a first side of said frame, ends of said first z-bar indexed to two said mounts of a first type and ends of said second z-bar indexed to two said mounts of a second type in one side of said frame to create said installed pair;

wherein said tensioning wires when installed are connected to said mounts that oppose those mounts indexed to said first and second z-bars, respectively, and wherein once said protective panels are slid into said slots provided by an installed said pair of z-bars, said z-bars are tensioned using their respective said adjustable tensioners;

four adjustable bases incorporating at least one first indexing device, wherein each said base as installed is in operable communication with at least one said mount of a second type;

first receiving arrangements on said mounts of a second type that mate to said first indexing devices of said bases; and second receiving arrangements on said mounts of a second type that mate to said indexing tabs of said mounts of a first type, wherein said protective panels are installed before tensioning said z-bars because the weight of said protective panels facilitates optimum tensioning of said z-bars, and wherein said protective panels are mounted in said z-bars to provide physical protection of assets on the side of said configuration opposite the side of said configuration facing away from said assets.

17. The support of claim 16 in which a proximal end of each said first and second wires is affixed one to each end of each said z-bar and said adjustable tensioner comprises an adjusting strap incorporating a ratchet and hook at the distal end of each said wire.

18. The support of claim 16 in which said first indexing devices comprise first vertically oriented rods at least in the corners of the top of one side of said base.

19. The support of claim 16 in which said first receiving arrangements on said mount of a second type to said base comprises at least one circular opening positioned to accept a said first vertically oriented rod and align said mount of a second type to parallel sides of one corner of said base.

20. The support of claim 16 in which said second receiving arrangements on said bottom mounts of a second type that mate to said indexing tabs of said mounts of a first type comprises said opening positioned in said mount of a second type to accept a second vertically oriented rod incorporated in said mount of a first type.

21. The support of claim 1 in which said cross members are hollow and have a quadrilateral cross section.

22. A support for a configuration providing mobile protection from airborne projectiles, comprising:

a quadrilateral frame with an open top and an open bottom, comprising:

one each quadrilateral mount of a first type comprising:

an L-shaped channel along one corner of said mount of a first type, the open side of said L-shaped channel oriented to point toward a surface upon which said frame is placed;

first and second indexing tabs each said tab on opposing corners of said mount of a first type parallel to a respective leg of said L-shaped channel;

at least said mount of a first type incorporated at each of four corners of said frame thus establishing extremities of said open top;

one each mount of a second type at each of said four corners that establish extremities of said bottom, said mount of a second type mirroring said L-shaped channels of said mount of a first type to allow said mount of a first type to connect to said mount of a second type, thus allowing said configuration to be built in multiple vertical layers of said frames, the open side of said L-shaped channel of said mount of a second type oriented to point away from a surface upon which said frame is placed;

at least one first arrangement for indexing said mount of a first type to said mount of a second type when using said frame to add an upper layer of frames to a structure with an existing lower layer of frames;

at least one second arrangement for securing said mount of a first type to an adjacent said mount of a first type to extend the horizontal length of said configuration;

a pair of cross members in compression on each of said four sides of said frame, each said cross member establishing a diagonal connection between a said mount of a first type and a said mount of a second type, wherein each said cross member of said pair is pivotally joined at its center to the center of said other cross member of said pair, and wherein each said cross member is pivotally joined to one said mount of a first type and one said mount of a second type to allow pivoting of said pair of cross members in a plane parallel to said side containing said pair of cross members;

at least first and second members in tension on each said side, ends of one said first member in tension attached horizontally to each said mount of a first type in each said side and ends of one said second member in tension attached horizontally to each said mount of a second type in each said side;

at least one pair of z-bars, each said z-bar comprising integral open channels facing opposite directions to insert protective panels therein and slots formed at each end on one side of said z-bar for indexing said z-bar to said frame, each said z-bar incorporating an adjustable tensioner on each end located so as to be behind any installed said protective panels, wherein said z-bars are affixed along at least a first longitudinal side of said frame, each end of a said first z-bar of said pair affixed to one of two said mounts of a first type at the extremities of the top of said first longitudinal side and each end of a said second z-bar of said pair affixed to one of two said mounts of a second type at the extremities of the bottom of said first longitudinal side; and four leveling bases, adjustable at least in height, indexed to each bottom corner of said frame via at least one first type of rod in each said base that mates with an opening in said mount of a second type as employed when said mount of a second type is incorporated on said frame used as a bottommost frame in said configuration, wherein each said base is in operable communication both with at least one each said mount of a second type and a surface upon which said bases rest, and wherein each said base may accommodate up to at least three said mounts of a second type in forming said configuration.

23. The support of claim 22 in which each said base further comprises:

a bottom plate configured to accept a non-threaded end of a second type of rod having a threaded portion; and a top plate configured to accept said threaded portion of said rod of a second type in a matching threaded bearing in the center of said top plate, wherein said rod is in operable communication with said bottom plate and said top plate and configured to be rotated and moved in relation to said top plate for adjusting the height of said frame.

24. The support of claim 22 in which said z-bars comprise integral first and second open rectangular channels, the open portion of a first said channel facing to said top and the open portion of a second said channel facing to said bottom of said support, said channels incorporating open ends, said z-bars much longer in length than either width or depth.

25. Support for a transportable configuration that provides protection for assets, comprising:

a stackable frame open at the top and bottom of said frame, said frame having four sides and eight corners, comprising:

first and second type mounts at each of said eight corners of said frame, four said mounts of a first type located at said top of said frame, one at each corner, said mounts of a first type comprising in part an L-shaped channel along one corner for securing tubes having a quadrilateral cross section, the open side of said L-shaped channel oriented to point toward a surface upon which said frame is placed, first and second indexing tabs pointing away from said surface, each said indexing tab on opposing corners of said mount of a first type and parallel to a respective leg of said L-shaped channel and four said mounts of a second type located on the four corners at said bottom of said frame, said mount of a second type mirroring said L-shaped channels of said mount of a first type by having said open side of said L-shaped channels oriented opposite those of said mounts of a first type to allow said mount of a first type to connect to said mount of a second type, thus allowing said configuration to be built in multiple vertical layers of said frames;

at least one third indexing arrangement incorporated in said mount of a second type permitting mating to said mount of a first type when using said frame to add an upper layer of said frame to a structure with an existing lower layer of said frames;

wherein each said mount of a first type on a first frame is configured to allow connection to another said mount of a first type that is a part of a second said frame abutting said first said frame to allow horizontal connection of said frames one to another;

a pair of cross members in compression on each of said four sides of said frame, each said cross member of said pair pivotally joined at its center to the center of the other said cross member of said pair and pivotally joined to one said mount of a first type and one said mount of a second type diagonally opposite said mount of a first type on the same side of said frame so as to allow pivoting of said pair of cross members in one plane parallel to said same side;

at least first and second members in tension positioned on each of said four sides of said frame, said first member horizontally attached to respective said mounts of a first type and said second member horizontally attached to respective said mounts of a second type;

at least first and second z-bars, each said z-bar comprising two abutting open channels facing opposite directions to create a "z" when viewed from an end, an installed pair of said z-bars allowing inserting protective panels therein, said z-bars incorporating raised slots formed at each end on one side of said z-bar that allow indexing said z-bar to said frame, each said z-bar incorporating first and second tensioning wires, a proximal end of each said first and second wires affixed one to each end of each said z-bar and an adjusting strap incorporating a ratchet and hook at the distal end of each said wire, said tensioning wires connected on each said raised slot so as to be behind any installed said protective panels, said z-bars horizontally affixed along at least a first side of said frame, ends of said first z-bar indexed to two said mounts of a first type and ends of said second z-bar indexed to two said mounts of a second type in one side of said frame to create said installed pair;

wherein said tensioning wires when installed are connected to said mounts that oppose those mounts indexed to said first and second z-bars, respectively, and wherein once said protective panels are slid into said slots provided by an installed said pair of z-bars, said z-bars are tensioned using their respective said adjusting straps;

four adjustable bases incorporating at least one first indexing device, wherein each said base as installed is in operable communication with at least one said mount of a second type;

first receiving arrangements on said mounts of a second type that mate to said first indexing devices of said bases; and second receiving arrangements on said mounts of a second type that mate to said indexing tabs of said mounts of a first type, wherein said protective panels are installed before tensioning said z-bars because the weight of said protective panels facilitates optimum tensioning of said z-bars, and wherein said protective panels are mounted in said z-bars to provide physical protection of assets on the side of said configuration opposite the side of said configuration facing away from said assets.

* * * * *